US005722257A

United States Patent [19]

Ishii et al.

[11] Patent Number: 5,722,257

[45] Date of Patent: Mar. 3, 1998

[54] COMPRESSOR HAVING REFRIGERANT INJECTION PORTS

[75] Inventors: Hiroki Ishii, Nishio; Mikio Matsuda, Okazaki; Masami Sanuki, Chiryu, all of Japan

[73] Assignees: Denso Corporation, Kariya; Nippon Soken, Inc., Nishio, both of Japan

[21] Appl. No.: 728,231

[22] Filed: Oct. 10, 1996

[30] Foreign Application Priority Data

Oct. 11, 1995 [JP] Japan ..... 7-263297
Nov. 9, 1995 [JP] Japan ..... 7-291123

[51] Int. Cl.[6] ..... F25B 31/00; F04C 18/04

[52] U.S. Cl. ..... 62/505; 62/510; 418/55.5; 418/97

[58] Field of Search ..... 62/505, 510, 115, 62/117, 228.1, 228.3, 228.5; 418/55.5, 55.4, 97

[56] References Cited

U.S. PATENT DOCUMENTS 4,475,360 10/1984 Suefuji et al. ..... 62/324.1
5,103,652 4/1992 Mizuno et al. ..... 62/505
5,253,489 10/1993 Yoshii ..... 62/505
5,329,788 7/1994 Caillat et al. ..... 62/505

*Primary Examiner*—William Doerrler
*Attorney, Agent, or Firm*—Cushman, Darby & Cushman IP Group of Pillsbury, Madison & Sutro LLP

[57] ABSTRACT

A scroll compressor having injection ports 70A and 70B opened to operating chambers Vc during a predetermined period of a complete compression cycle, so that a part of the refrigerant circulating in a refrigerating system is injected into the compression chambers from the injection ports. The injection ports are opened to an intermediate pressure chamber, which is at a pressure between the pressure of the refrigerant sucked into the compressor and the pressure of the refrigerant discharged from the compressor. The intermediate pressure chamber is arranged so as to eliminate pressure pulsations therein. Check valves 72A and 72B are provided in an end plate 54 of a stationary scroll member 50. Furthermore, relief valves may also be provided in the end plate for releasing the pressure of the operating chambers to a low pressure side of the refrigerating system.

5 Claims, 16 Drawing Sheets

COMPRESSOR HAVING REFRIGERANT INJECTION PORTS

BACKGROUND OF THE INVENTION

1. Field of the Invention

The present invention relates to a compressor used for a refrigerating system wherein a so-called injection cycle is executed. The present invention can be suitably applied to a scroll type compressor.

2. Background of the Invention

A refrigerating system is known, wherein a two stage expansion (pressure reduction) is done between a condenser and an evaporator by injecting a refrigerant, under a medium pressure after passed through a first stage pressure reducer, into an operating chamber of the compressor which is performing a compression operation. Such a two stage pressure reduction is for increasing efficiency during the execution of the refrigerating cycle. The refrigerant is injected into the operating chamber performing the compression operation from an injection port by using a pressure difference between the gas-liquid separator (injection pressure) and the operating chamber of the compressor. Thus, in order to execute the injection operation, it is essential that injection pressure is higher than the pressure in the operating chamber of the compressor. In other words, a pressure in the operating chamber of the compressor higher than the injection pressure at the injection port necessarily causes a reverse flow to be generated, where the refrigerant in the operating chamber of the compressor flows back to the gas-liquid separator.

Thus, in order to obviate this problem, it has been proposed to arrange a check valve between the gas-liquid separator and the injection port. For example, in a scroll compressor disclosed in the Japanese Unexamined Patent Publication No. 58-148209, a check valve is arranged in a chamber formed between an end plate of a stationary scroll member and a casing. The check valve in the chamber is connected, via a conduit for a refrigerant, to an injection port formed in the end plate of the stationary scroll member.

According to a test by the inventors, it has found that the prior art structure cannot obtain a desired increase in the efficiency in the refrigerating cycle irrespective of a fact that an injection of the refrigerant of a medium pressure into the operating chamber of the compressor is done via the injection port which is opened for a predetermined duration of time. According to the test by the inventors, it was found that the pressure pulsation at the outlet of the compressor is transmitted to the gas-liquid separator, which makes the pressure of the refrigerant to pulsate at the gas-liquid separator, which causes the injection pressure to pulsate. Such a pulsation of the injection pressure causes the amount of actually injected refrigerant to be smaller than the amount calculated using the duration of the injection period, which makes it difficult to obtain an increased efficiency of the injection cycle.

SUMMARY OF THE INVENTION

An object of the present invention is to provide an injection system of an increased efficiency by suppressing a pulsation in the pressure of the refrigerant injected to operating chambers of a compressor.

According to one embodiment of the invention, an intermediate pressure chamber is provided so that it is in communication with an injection port for elimination of a pressure pulsation in the refrigerant as introduced into the operating chambers.

According to a further embodiment of the invention, an injection port is formed in an end plate of a stationary scroll member and an intermediate pressure chamber, to which the injection port is opened, is provided, so that the pressure variations at the intermediate pressure chamber can be reduced, i.e., a pressure pulsation is eliminated.

According to the present invention, an intermediate pressure chamber is provided, so that the injection port is in communication with the intermediate pressure chamber, and so that a stable injection of the fluid or refrigerant is obtained during an injection period, where the injection port is opened to the operating chamber. As a result, a stabilized injection of the fluid or refrigerant is obtained, thereby obtaining a desired improvement in the injection cycle efficiency.

BRIEF EXPLANATION OF ATTACHED DRAWINGS

DESCRIPTION OF PREFERRED EMBODIMENTS

Figure 1:
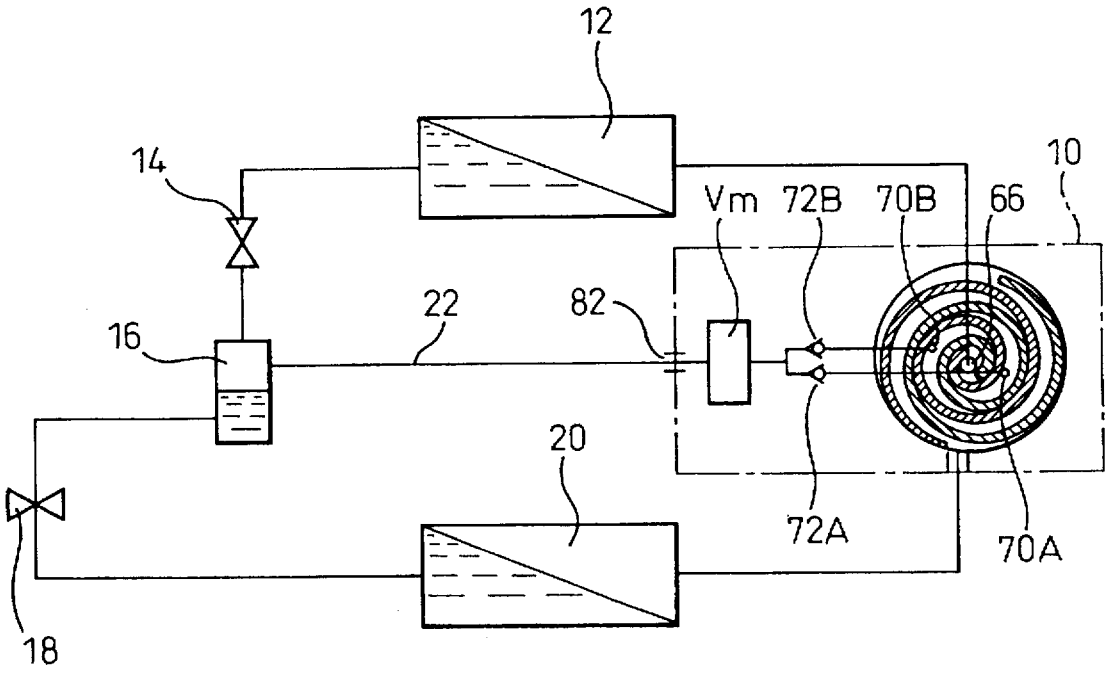
FIG. 1 is an entire schematic view of an injection system according to the present invention.

Now, a first embodiment of the present invention will be explained with reference to the attached drawings. FIG. 1 schematically illustrates a refrigerating system for use in an air conditioning system for a vehicle provided with an internal combustion engine. The refrigerating system is constructed by a compressor 10, which is constructed as a scroll compressor, a condenser 12, a first throttle valve 14 of a fixed throttle type (a first pressure reducer), a gas-liquid separator 16, a second throttle valve 18 of a fixed throttle type (a second pressure reducer), and an evaporator 20. In a well known manner, compression of the refrigerant occurs at the compressor 10, so that the compressed refrigerant is discharged from the compressor 10 and is introduced into the condenser 12. At the condenser 12, as a result of a heat exchange with a flow of outside air, an emission of a heat from the refrigerant occurs, so that the refrigerant is cooled and liquidized and is introduced into the first throttle valve 14. At the first throttle valve 14, a reduction of the pressure of the refrigerant occurs, thereby obtaining a gas-liquid combined state of the refrigerant, which is stored in the gas-liquid separator 16. A liquid state refrigerant separated at the gas-liquid separator 16 is directed into the second throttle valve 18, where the refrigerant is, again, subjected to a pressure reduction, so that a mist state of the refrigerant is obtained, which is introduced into the evaporator 20. At the evaporator 20, as a result of a heat exchange with a flow of an outside air, an absorption of the heat is occurred, so that the refrigerant is heated and evaporated, so that a gaseous state of the refrigerant is obtained, which is introduced into the compressor 10 for repetition of the cycle.

The refrigerating system is further provided with an injection system, which includes a conduit 22, which is for connecting the separator 16 at a location above gas-liquid boundary with an intermediate pressure chamber Vm of the compressor 10, which will be fully described later. Furthermore, check valves 72A and 72B for connecting the intermediate pressure chamber Vm with injection ports 70A and 70B are also provided, as will also be explained later.

Figure 2:
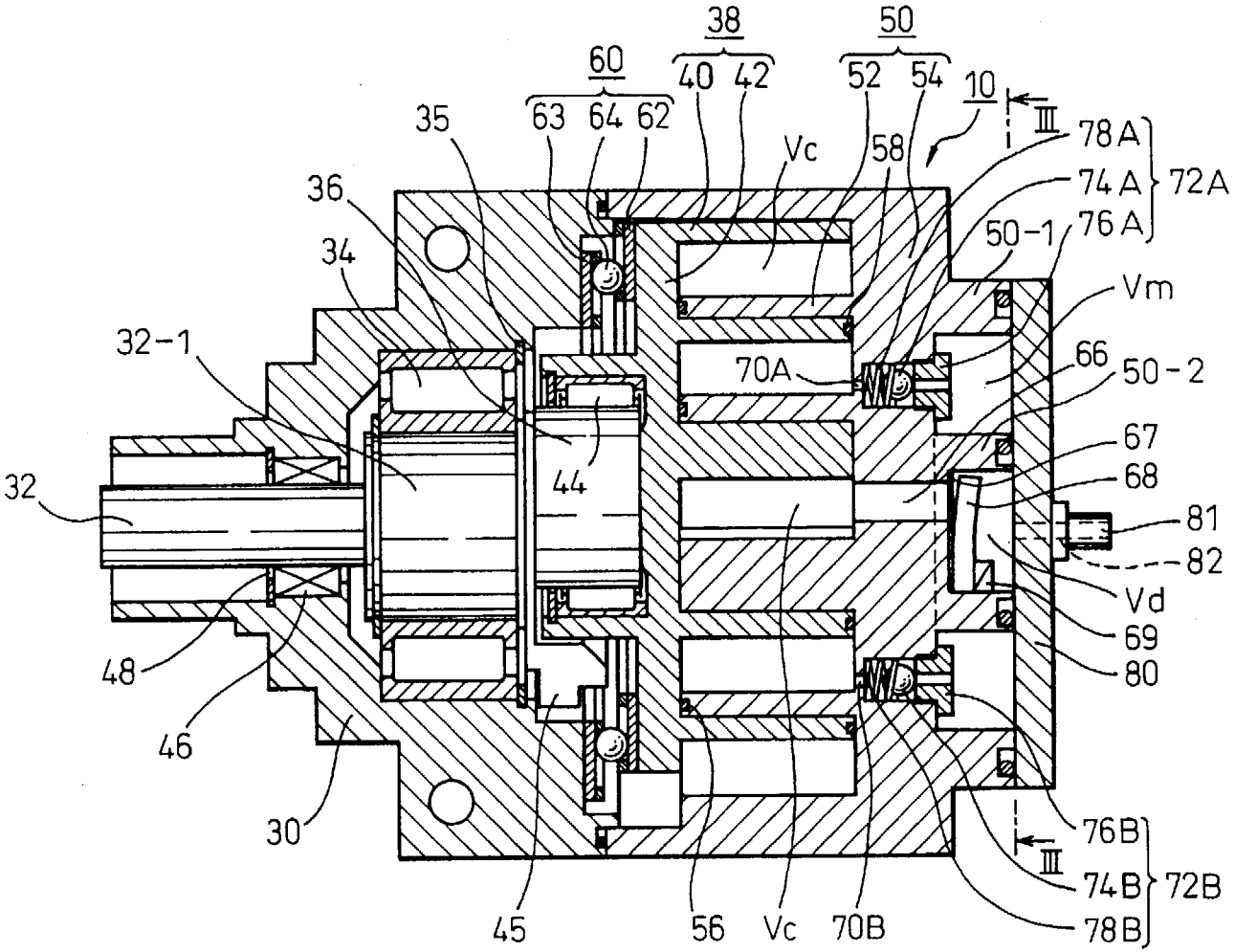
FIG. 2 is a longitudinal cross sectional view of a scroll compressor in FIG. 1.

FIG. 2 shows a detail of the scroll compressor 10, which includes a front housing 30, by which a rotating shaft 32 is, at its inner end 32-1, rotatably supported by means of a roller bearing assembly 34, which is press fitted to the front housing 30 and is fixed thereto by means of a circlip 35. The rotating shaft 32 has an outer end projected out of the front housing 30, to which an electromagnetic clutch (not shown) is connected, which is for a selective connection of the rotating shaft 32 to a crankshaft (not shown) of the internal combustion engine. As a result, an engagement of the electromagnetic clutch causes a rotating movement to be transmitted to the rotating shaft 32.

In a well known technique, in place of the electromagnetic clutch for the selective connection of the rotating movement of the internal combustion engine to the compressor, an electric motor can be provided for generating an independent rotating movement, which is transmitted to the compressor.

Connected integrally to the inner end 32-1 of the rotating shaft 32 is a crank member 36, so that a predetermined value of an offset of the crank member 36 is obtained with respect to the shaft 32. A movable scroll member 38, which is constructed by a scroll member 40 and an end plate 42, is rotatably connected to the crank member 36 via a roller bearing assembly 44. As a result, a rotating movement of the shaft 32 causes the movable scroll member 38 to be subjected to an orbital movement of a radius corresponding to the offset amount of the crank member 34 with respect to the axis of the shaft 32. A balancer 45 is connected to the crank member 36, which is for canceling a vibration which is otherwise generated during the orbital movement of the crank member 36 and the movable scroll member 38 mounted thereon.

It should be noted that, in place of the crank member 36, a well known variable crank mechanism can be employed, which is constructed by a driving key which is integrally formed with respect to the shaft 32 and a bushing which has a radial groove, into which the driving key is radially slidably inserted.

A shaft seal unit 46 is arranged outwardly adjacent the roller bearing unit 34 for sealing the space between the rotating shaft 32 and the front housing 30, thereby preventing the refrigerant as well as a lubricant mixed therewith from leaking from the compressor 10. The bearing unit 34 is located at a fixed position on the rotating shaft 32 by means of a circlip 48.

A reference numeral 50 denotes a stationary scroll member, which is constructed by a scroll wall 52 and an end plate 54, which are formed integrally with each other. The scroll wall 52 of the stationary scroll member 50 is in side by side engagement with the scroll wall 40 of the movable scroll member 38. Thus, the engaged scroll walls 40 and 52, in cooperation with the end walls 42 and 54, delimit a plurality of operating chambers Vc for suction and compression of the refrigerant. At ends of the scroll walls 40 and 52, facing the opposite end walls 54 and 42, respectively, tip seal members 56 and 58 are arranged, so that a fluid seal is obtained between the scroll walls 40 and 52 and the faced end walls 54 and 42, respectively.

A reference numeral 60 denotes a self rotation blocking mechanism for preventing the movable scroll member 38 from being rotated about its own axis. The self rotation blocking mechanism 60 is constructed by a first ring member 62 fixedly connected to the end wall 42 of the movable scroll member 38, a second ring member 63 axially spaced from the first ring member 62 and fixedly connected to the front housing 30 at its end faced with the movable scroll member 38 and a plurality of circumferentially spaced balls 64 arranged between the ring members 62 and 63.

The end wall 54 of the stationary scroll member 50 has, at its central location, an outlet opening 66, which is opened to the operating chamber Vc located as a radially inward position, so that the compressed refrigerant is discharged into the port 66. A check valve 67 formed as a reed valve is arranged so that it usually closes the outlet port 66. A stopper 68 together with the check valve 67 is fixedly connected to the end plate 54 of the stationary scroll member 50 by means of a bolt 69 and is arranged at a side of the check valve 67 at the side remote from the outlet port 66.

The end plate 54 of the stationary scroll member has, at a predetermined location, injection ports 70A and 70B, which are opened to the operating chambers Vc, which are in a predetermined phase of the compression operation at the operating chambers Vc, so that the gaseous refrigerant separated at the gas-liquid separator 16 in FIG. 1 is discharged into the respective operating chambers Vc. Ball shaped check valves 72A and 72B for preventing a reverse flow of the refrigerant are provided for the injection ports 70A and 70B, respectively. The check valve 72A is constructed by a valve member 74A of a ball shape, a valve seat member 76A of a sleeve shape and a spring 78A for urging the valve member 74A to be seated on the valve seat 76A.

The check valve 72B is of the same structure as that of the check valve 72A and is constructed by a valve member 74B, a valve seat member 76B and a spring 78B.

Figure 3:
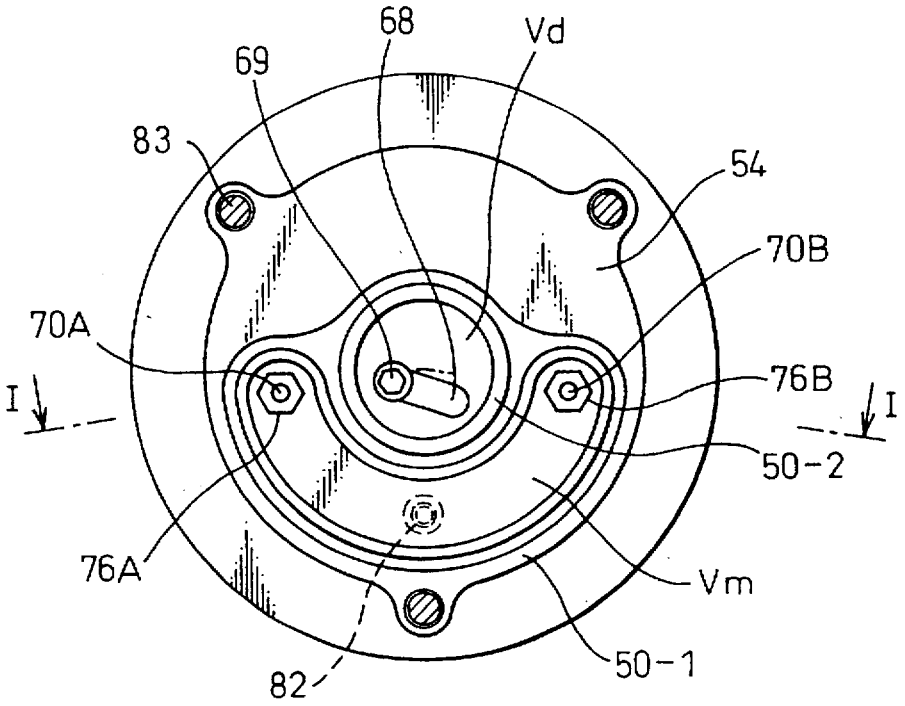
FIG. 3 is a view taken along a line III—III in FIG. 2.

The end plate 54 of the stationary scroll member 50 has axially projected portions 50-1 and 50-2, to which a rear plate 80 is fixedly connected by means of a suitable means such as bolts 83 (FIG. 3), so that radially spaced closed chambers are formed. Namely, an outlet chamber Vd is formed inside the inner projected portion 50-2, while a medium pressure chamber Vm is formed inside the projected portion 50-1 as shown in FIG. 3. The outlet chamber Vd is for diminishing the pulsations in the compressed refrigerant received from the outlet port 66. The medium pressure chamber Vm is for dividing the gaseous refrigerant into the injection ports 70A and 70b and for eliminating pulsations in the pressure at the intermediate pressure chamber Vm. An union 81 is connected to the plate 80, which is for connecting the outlet pressure chamber Vd with the condenser 12 in FIG. 1 via the opening not shown in FIG. 2.

As shown in FIG. 3, the projected portion 50-2 forms a closed loop of an arc shape so that the intermediate pressure chamber Vm is formed inside the closed loop of the projected portion 50-2. An intermediate pressure port 82, to which the union 81 is connected, is opened to the intermediate pressure chamber Vm, so that the gaseous refrigerant separated at the gas-liquid separator 16 is introduced into the chamber Vm via the port 82. The intermediate pressure port 82 is arranged at the center portion of the arc shape of the chamber Vm as shown in FIG. 3, which allows the flow resistance to be equalized between the flow passageway from the intermediate port 82 to the first injection port 70A and the flow passageway from the intermediate port 82 to the second injection port 70B.

Figure 4:
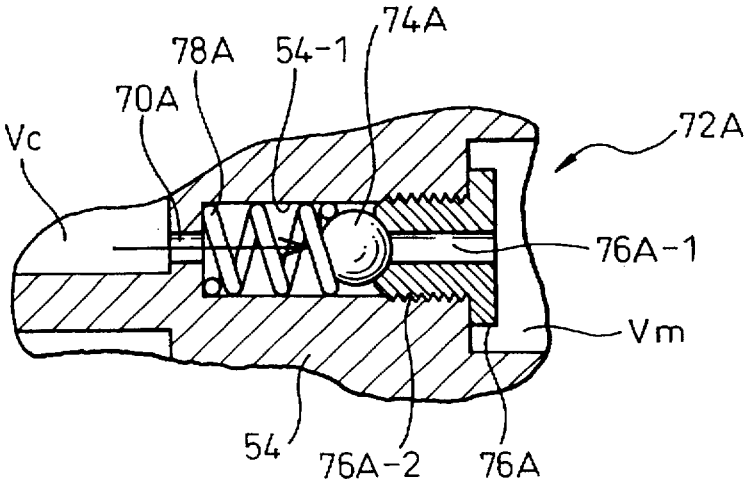
FIG. 4 is a partial, enlarged view of FIG. 3 for illustrating closed position of the check valve.
Figure 5:
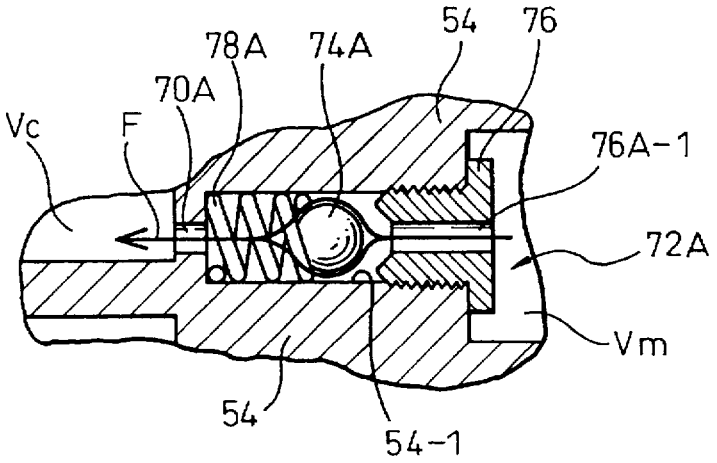
FIG. 5 is a partial, enlarged view of FIG. 3 for illustrating an opened position of the check valve.

FIG. 4 shows details of the check valve 72A. The check valve 72B has the same structure as that of the first check valve 72B, and thus only the detail of the valve 72A will be explained. Namely, the end plate 54 is formed with a check valve port 54-1 of a diameter larger than that of the injection port 70A. The check valve port 54-1 is arranged concentrically with the injection port 70A and extends from the end surface of the plate 54 adjacent the intermediate pressure chamber Vm for a predetermined distance. The stopper sleeve (valve seat member) 76A is formed with a central bore 76A-1 for a passage of the refrigerant and with a screw thread 76A-2 for tightening the sleeve 76A to the end plate 54 (stationary scroll member 50). The ball valve 74A is for selectively closing the valve passageway 76A-1 and is normally seated on the valve seat at the inner end of the sleeve 76A under the spring force of the spring 78A. It should be noted that FIG. 4 shows a closed condition of the check valve 72A, while FIG. 5 shows an opened condition of the check valve 72A.

Figure 6:
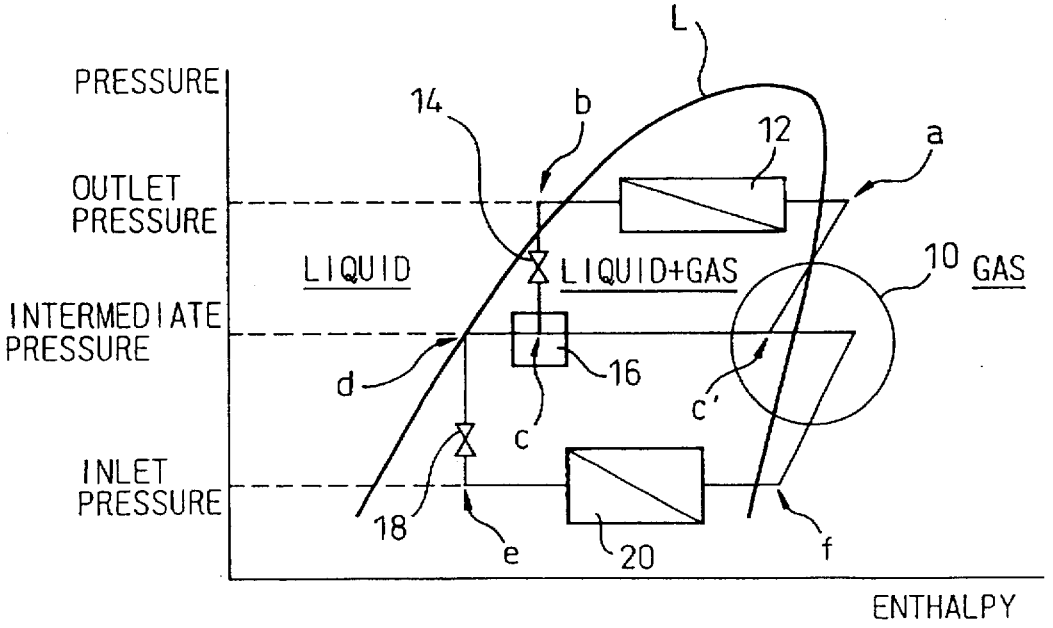
FIG. 6 is a Mollier chart for illustrating an operation of the injection system in FIG. 1.

Now, an operation of the above explained embodiment will be explained by reference to a Mollier chart, where the abscissa is specific enthalpy and the ordinate is pressure. In the chart, the refrigerant outside an equilibrium line L of a higher enthalpy is in a gaseous state, while the refrigerant outside the equilibrium line L of a lower enthalpy side is in a liquid state. The refrigerant inside the equilibrium line L is in a gas-liquid combined state. The gaseous refrigerant subjected to the compression at the compression 10 is discharged from the outlet port 66 at a high pressure (outlet pressure) as shown by a point a. The gaseous refrigerant of a high pressure and a high temperature from the compressor 10 is condensed at the condenser 12 and is finally liquidized at point b of the chart. The liquid state refrigerant is subjected to a first stage expansion at the orifice 14 so that a gas-liquid combined (mist) state of the refrigerant of an intermediate pressure as shown by a point c in FIG. 6 is obtained. The mist state refrigerant is subjected to a gas-liquid separation at the separator 16, so that a phase separation between the gaseous state and the liquid state occurs at the separator 16.

The gaseous phase portion of the refrigerant at the separator 16 is subjected to elimination of pressure pulsations at the intermediate pressure chamber Vm of the compressor 10, and is passed through the check valves **72*a* and 72*b* and injected into the operation chambers Vc via the injection ports 70*a* and 70*b*. The injected gas together with the existing refrigerant in the compressor 10 is subjected to the compression as shown by a point c' in FIG. 6**.

The liquid portion of the refrigerant at the separator 16 at a point d in FIG. 6 is subjected to a second stage expansion at the orifice 18, so that a liquid-gas combined (mist) state refrigerant is obtained, while the pressure of the refrigerant is reduced to an inlet pressure as shown by a point e in FIG. 6. The mist state refrigerant is subjected to an evaporation at the evaporator 20, so that the refrigerant is gasified as shown by a point f in FIG. 6 and is supplied to the compressor 10 for a repetition of the above cycle.

Figure 7:
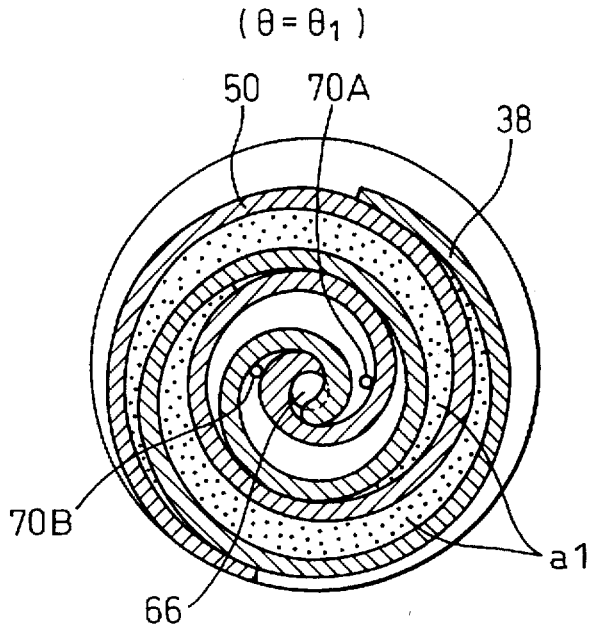
FIGS. 7 to 10 illustrate successive 90 degree rotated positions of a movable scroll member during one compression cycle of the scroll compressor.
Figure 8:
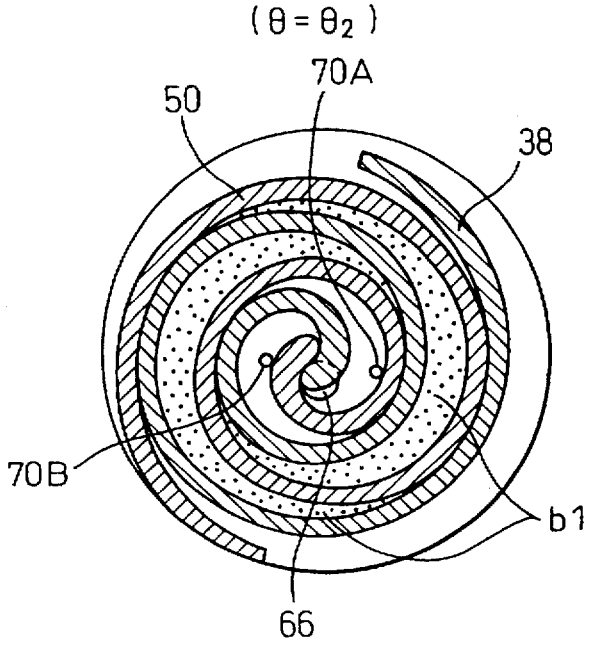
Figure 9:
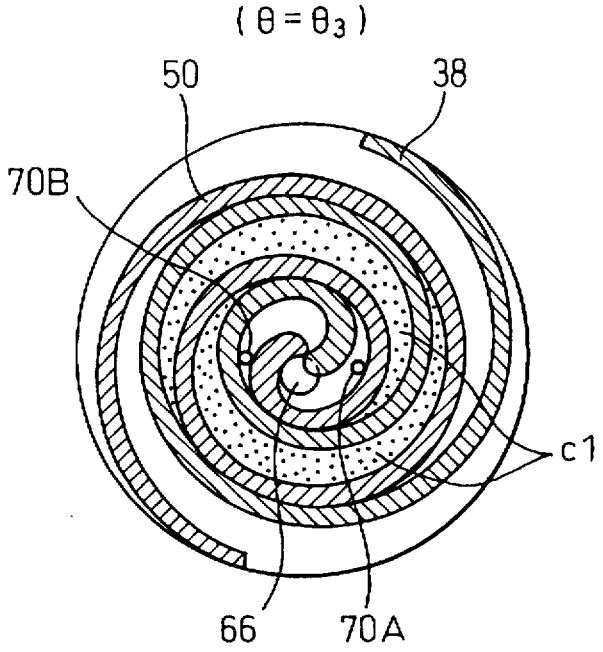
Figure 10:
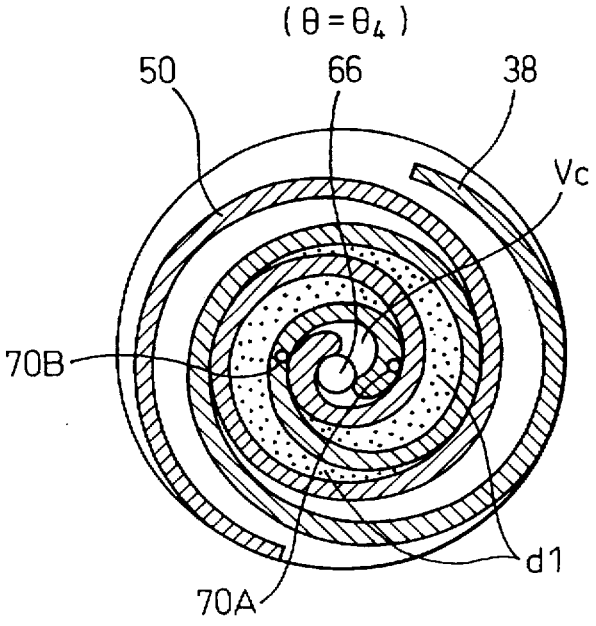

Now, the operation of the compressor 10 will be explained in more detail. Namely, FIGS. 7 to 10 show different angular positions of the movable scroll member 38 with respect to the stationary scroll member 50 for every 90 degree rotation of the movable scroll member 90 during a single complete rotation. As is well known, the scroll compressor provides pair of operating chambers Vc of the same volume, which are reduced gradually during the rotating movement of the movable scroll member 38 for causing the gaseous refrigerant to be subjected to compression. In FIG. 7, where the rotating angle θ of the rotating shaft (movable scroll member 38) is $\theta_1$ degree, dotted area $a_1$ show one of such a pair located at a radially outer position. After 90 degree rotation of the movable scroll member ($\theta=\theta_2$), the paired operating chambers are shown by dotted areas $b_1$ in FIG. 8. The position of the paired operating chambers after the next 90 degrees of rotation ($\theta=\theta_3$) are shown by dotted areas $c_1$. The next 90 degrees of rotating movement ($\theta=\theta_4$) causes the paired operating chambers to be located as shown by the dotted areas $d_1$. In short, the rotating movement of the movable scroll member 38 causes the operating chambers Vc to be moved radially while the volume is gradually reduced, i.e., the pressure is gradually increased. As a result, the compression finally causes the pressure of the refrigerant at the operating chambers Vc to be higher than the pressure at the condenser 12, which causes the outlet valve 67 to be opened, so that the refrigerant in the operating chamber Vc is discharged, via the outlet port 66, into the delivery chamber Vd.

Figure 11:
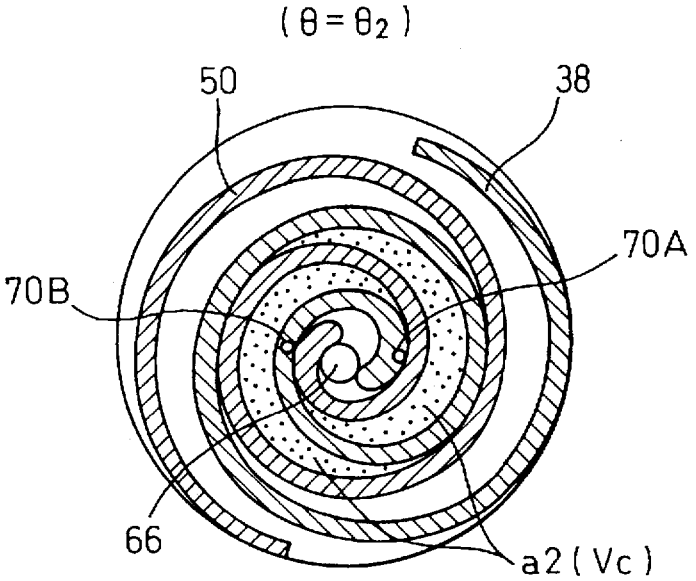
FIGS. 11 to 14 illustrate successive 90 degree rotated positions of a movable scroll member and thus illustrate the relationship between injection ports and paired operating chambers.
Figure 12:
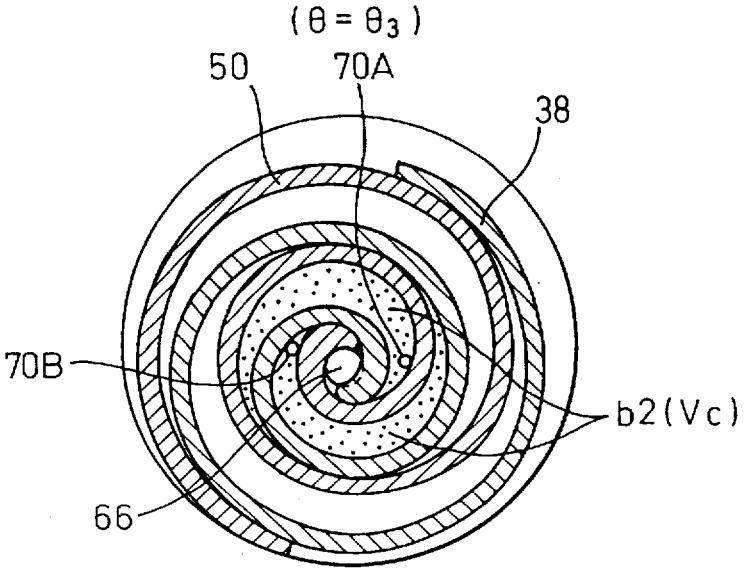
Figure 13:
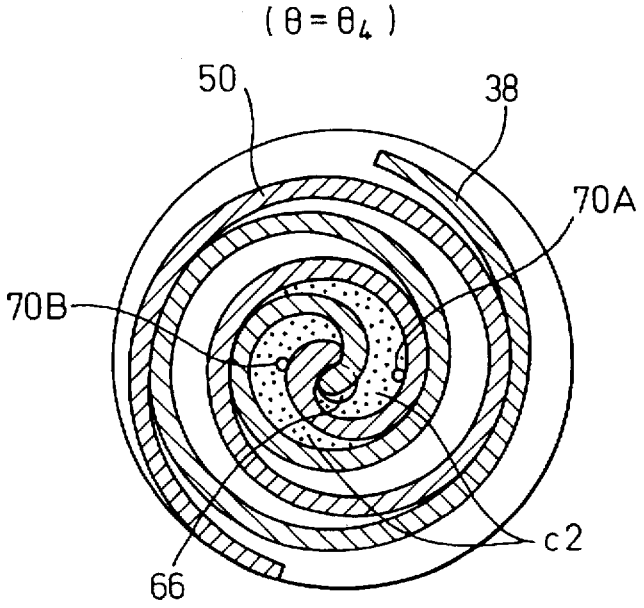
Figure 14:
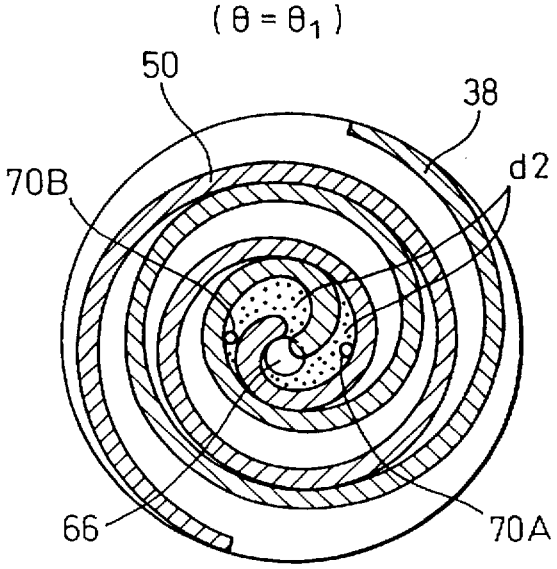

Now, the detail of the gas injection cycle will be explained with reference to FIGS. 11 to 12. FIG. 11 shows the angular position ($\theta=\theta_2$), which is the same as that in FIG. 8. At this position, the paired operating chambers, which are located at radially intermediate position and are shown by dotted areas $a_2$, are still disconnected from the injection ports 70A and 70B, respectively. The 90 degree rotation of the rotating shaft 32 (movable scroll member 38) to the angular position ($\theta=\theta_3$) as shown in FIG. 12 causes the paired chambers to be radially inwardly moved to the position shown by the dotted area $b_2$, which causes the chambers to be opened to the injection ports 70A and 70B, respectively. A further 90 degree rotation of the movable scroll member 38 to the angular position ($\theta=\theta_4$) as shown in FIG. 13 causes the paired chambers Vc to be further radially inwardly moved to the position shown by the dotted area $c_2$, so that the refrigerant is further compressed. Finally, a further 90 degree rotation of the movable scroll member 38 to the angular position ($\theta=\theta_1$) as shown in FIG. 14 causes the paired chambers Vc to take the radially innermost position shown by the dotted area $d_2$, so that the refrigerant is fully compressed. When the operating chambers Vc are in communication with the injection ports 70A and 70B as shown in FIGS. 12 to 14, a radially outer position of the compression chambers causes the pressure of the operating chambers Vc to be smaller than the intermediate chamber Vm (FIG. 2), which corresponds to the pressure in the gas-liquid separator 16 (FIG. 2), so that the valve ball 74A is moved against the force of the spring 78A as shown in FIG. 5, thereby causing the valve ball 74A to be detached from the valve seat member 76A. As a result, a gaseous refrigerant in the intermediate pressure chamber Vm is injected into the operating chambers Vc from the injection port 70A (70B) as shown by an arrow F, via the passageway 76A-1 and an annular gap between the ball valve 74A and the inner surface of the bore 54-1. It should be noted that, prior to the gas injection as above mentioned, a reduction or an elimination in pressure pulsations occurs in the intermediate pressure chamber Vm.

The radially inward movement of the operating chambers Vc causes the pressure of the operating chambers Vc to be higher than the intermediate chamber Vm (the pressure at the gas-liquid separator 16), so that the valve ball 74A is moved toward the valve seat member 76A, thereby causing the valve ball 74A to be seated on the valve seat member 76A as shown in FIG. 4. As a result, injection of the gaseous refrigerant from the intermediate pressure chamber Vm is stopped. A lack of the check valves 72A and 72B would cause the high pressure refrigerant at the operating chamber Vc to flow back into the gas-liquid separator 16 via the intermediate pressure chamber Vm due to the fact that the pressure at the operating chamber Vc is higher than the pressure at the gas-liquid separator 16.

It should be noted that the pressure at the separator 16 is varied in accordance with a load of the injection cycle, so that the duration of the gas injection into the operating chamber Vc is varied in accordance with the load of the injection cycle.

According to the first embodiment of the present invention, the gas injection from the injection ports 70A and 70B to the operating chambers Vc is done after the elimination of the pressure pulsations in the intermediate pressure chamber Vm, so that the gas injection becomes stable during an injection period, where the injection ports 70A and 70B are in an opened condition. In other words, an amount of the injected gas which corresponds to the injection period is obtained, thereby enhancing the efficiency of the gas injection cycle.

According to the first embodiment of the present invention, the intermediate chamber Vm is located inside the compressor 10, i.e., in the space between the end plate 54 of the stationary scroll member 50 and the rear plate 80. Thus, any provision of an independent chamber for eliminating the pressure pulsation is unnecessary. As a result, extra parts such as joints, which would otherwise be essential, can be eliminated, thereby preventing the production cost from being increased and increasing the efficiency of a gas injection cycle.

Furthermore, the provision of the intermediate pressure port 82 is located at the center of the arc shape of the intermediate pressure chamber Vm in the vertical plane of the end plate of the stationary scroll member, in such a manner that the flow resistance from the intermediate pressure port 82, via intermediate pressure chamber Vm, to the injection port 70A and to the injection port 70 are balanced, thereby allowing the gas to be evenly injected from both of the injection ports 70A and 70B. As a result, an even increase in the pressure is obtained between the paired operating chambers Vc, thereby preventing the scroll walls 40 and 52 of the movable and stationary scroll members 38 and 50, respectively, from being improperly loaded. Thus, damage to, as well as a malfunction of the parts, which may otherwise occur, can be prevented. Furthermore, an even gas injection is obtained between the paired operating chambers Vc, thereby increasing the efficiency in the gas injection, when compared with that when uneven gas injection occurs at the paired chambers.

Due to the provision of the check valves 72A ad 72B at the end plate 54 of the stationary scroll member 50 where the injection ports 70A and 70B are formed, the dead volume from the operating chambers Vc to the check valves 72A and 72B (the balls 74A and 74B), can be reduced. As a result, a reduction in the amount of work which is necessary for discharging an amount of the refrigerant corresponding to the amount of the dead volume and which corresponds to a product of the dead volume and the discharge pressure of the refrigerant, is possible, thereby reducing the power loss at the compressor 10.

Furthermore, introduction of the refrigerant to the injection ports 70A and 70B is done by way of the intermediate pressure chamber Vm. Thus, the provision of only one intermediate pressure port 82 is sufficient for a purpose of introduction of the intermediate pressure to the compressor 70, thereby eliminating a number of machining steps for production of the compressor 10, thereby reducing its production cost.

Figure 15:
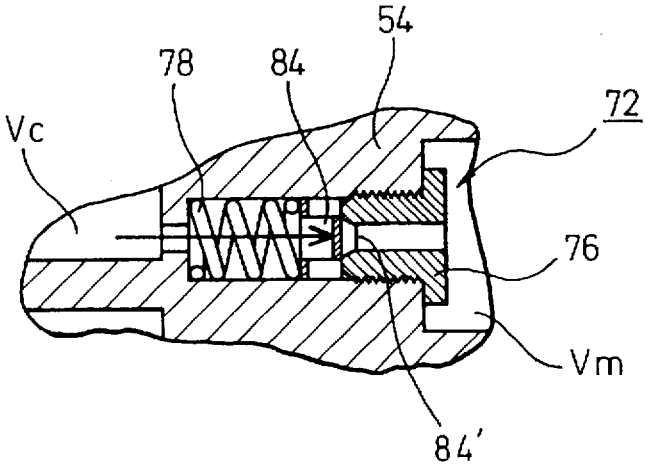
FIG. 15 illustrates a modification of a check valve of a spool valve type when it is in a closed position.
Figure 16:
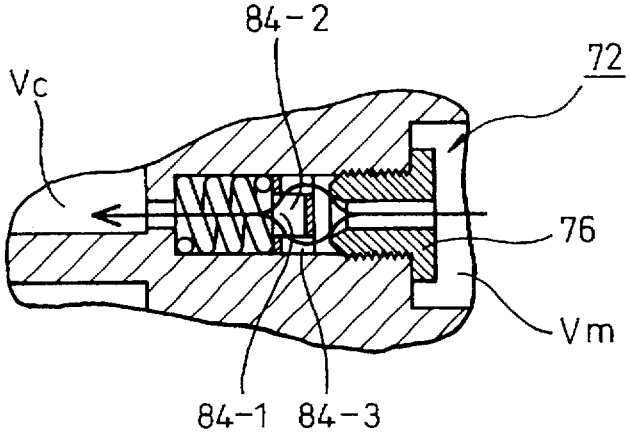
FIG. 16 illustrates an opened position of the spool type check valve in FIG. 15.
Figure 17:
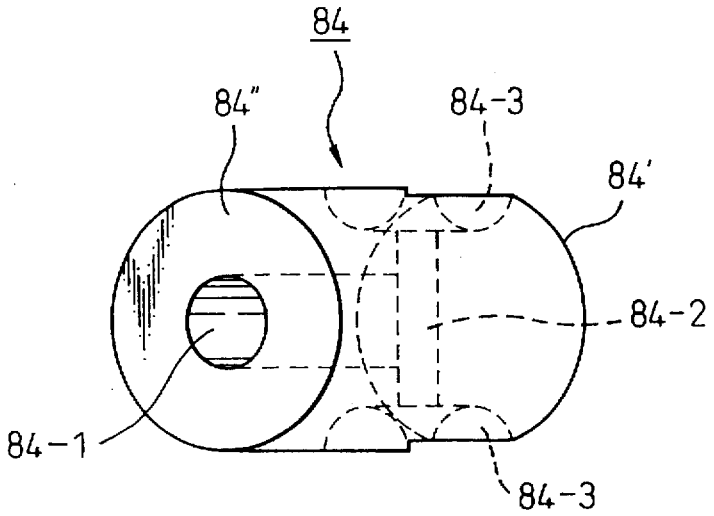
FIG. 17 is a perspective view of a spool valve in FIGS. 15 and 16.

In a modification shown in FIGS. 15 to 17, the ball shaped valve member 74 in the check valve 72 is replaced by a spool type valve member 84. As shown in FIG. 17, the spool type valve member 84 is formed as a spool having a closed end 84'. The valve member 84 is formed with an axial bore 84-1 opened to the end of the valve member opposite to the closed end 84', and a radial bore 84-2 extending radially therethrough in such a manner that the bores 84-1 and 84-2 are crossed and in communication with each other. The valve member 84 has, at its outer cylindrical surface, a pair of diametrically opposite grooves 84-3 to which the radial bore 84-3 is opened at its ends. Each of the grooves 84-3 extends axially so as to form a first end opened to the end surface 84' of the valve member 84 and a second end terminated at the location spaced from the opposite end surface 84" of the valve member 84. These bores 84-1 and 84-2 as well as the grooves 84-3 form a gas injection passageway according to the present invention.

FIG. 15 shows a condition, where the check valve 72 is closed due to the fact that the pressure at the operating chamber Vc is higher than the pressure at the intermediate pressure chamber Vm. In this case, under the action of the spring 78, the valve member is moved toward the sleeve member 76, so that the spool valve member 84 (FIG. 17) is, at its closed end 84', seated on the valve seat member 76, thereby preventing communication between the operating chamber Vc and the intermediate pressure chamber Vm.

FIG. 16 shows a condition where the check valve 72 is opened due to the fact that the pressure at the operating chamber Vc is lower than the pressure at the intermediate pressure chamber Vm. In this case, against the action of the spring 78, the valve member 84 is moved away from the sleeve member 76, thereby allowing communication between the operating chamber Vc and the intermediate pressure chamber Vm via the grooves 84-3, the radial bore 84-2 and the axial bore 84-1 as shown by an arrow in FIG. 16.

Figure 18:
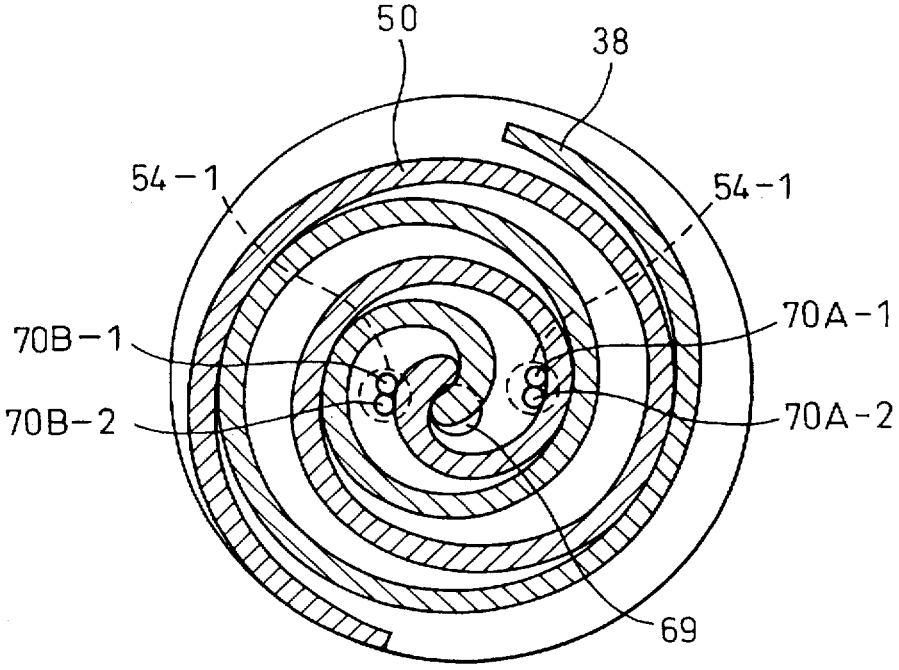
FIG. 18 illustrates a modification where a double construction of injection ports is employed.

FIG. 18 shows a modification of the refrigerating system according to the present invention, where four injection ports are provided in such a manner that two pairs of injection ports 70A-1 and 70A-2 and 72A-1 and 72A-2 are provided, so that the injection ports of each pair are opened to one and the same operation chambers. Namely, the injection ports 70A-1 and 70A-2 or 72A-1 and 72A-2 in each pair are arranged so as to be opened to a corresponding opening 54-1 which is opened to the operating chamber Vc and formed in the end plate 54 of the stationary scroll member 50.

According to this modification in FIG. 18, a total number of the injection ports is increased over that in the previous embodiments, thereby reducing the flow resistance when the refrigerant is passed to the injection ports. Thus, the intermediate pressure of the refrigerant, after passing the gas-liquid separator, is effectively used for the compression at the compressor, thereby enhancing the efficiency of the gas injection cycle.

Figure 19:
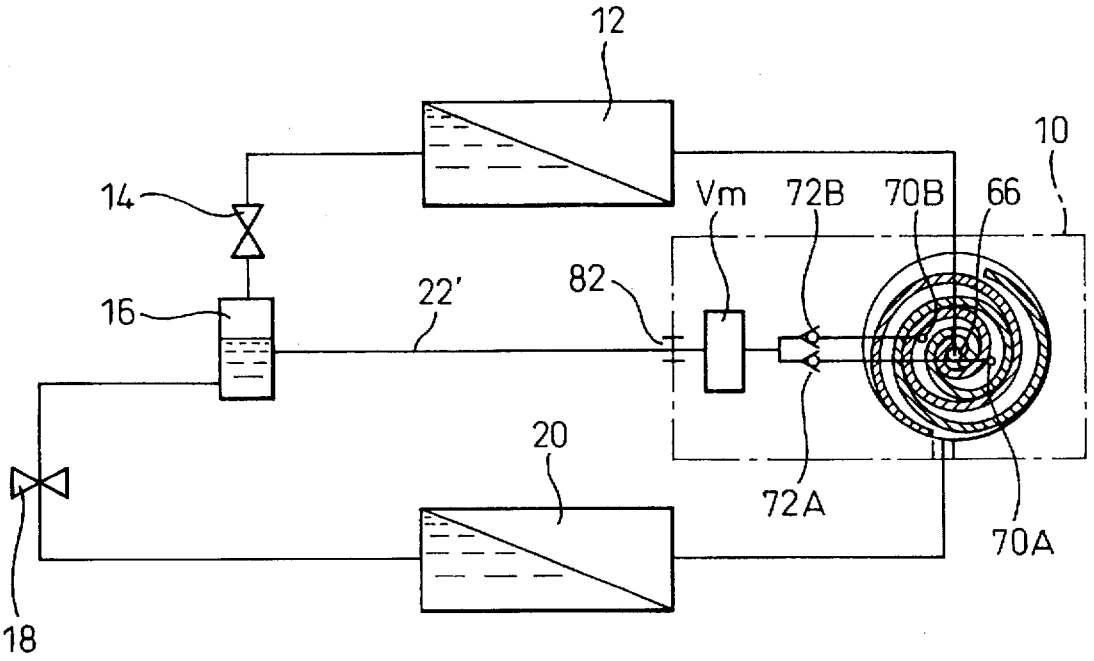
FIG. 19 illustrates a modified arrangement which is practiced in a liquid injection system.

FIG. 19 is a modification of the present invention, applied to a liquid injection cycle, where the refrigerant under a liquid state is injected to the operating chambers of the compressor. Namely, as shown in FIG. 19, a conduit 22' is provided so that the gas-liquid separator 16 at a location of the liquid portion is connected to the intermediate pressure chamber Vm. The remaining construction of the modification in FIG. 19 is identical with that in the embodiment in FIG. 1. Namely, compared to the gas injection system in FIG. 1, a mere change of the location of the gas-liquid separator 16 for taking out the refrigerant therefrom is sufficient for constructing the liquid injection system. In other words, a slight modification in the design is sufficient for changing from the gas injection system to a liquid injection system, while maintaining a substantially unchanged advantage.

Figure 20:
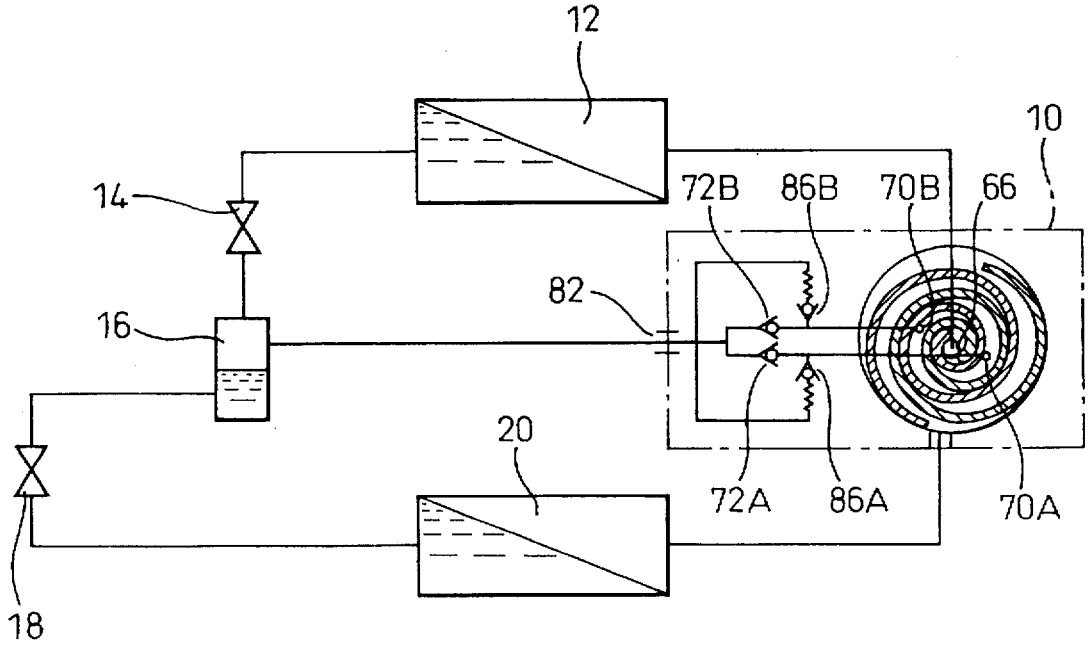
FIG. 20 is schematic view of the entire system of a second embodiment of the present invention, where, in addition to check valves, relief valves are provided.
Figure 21:
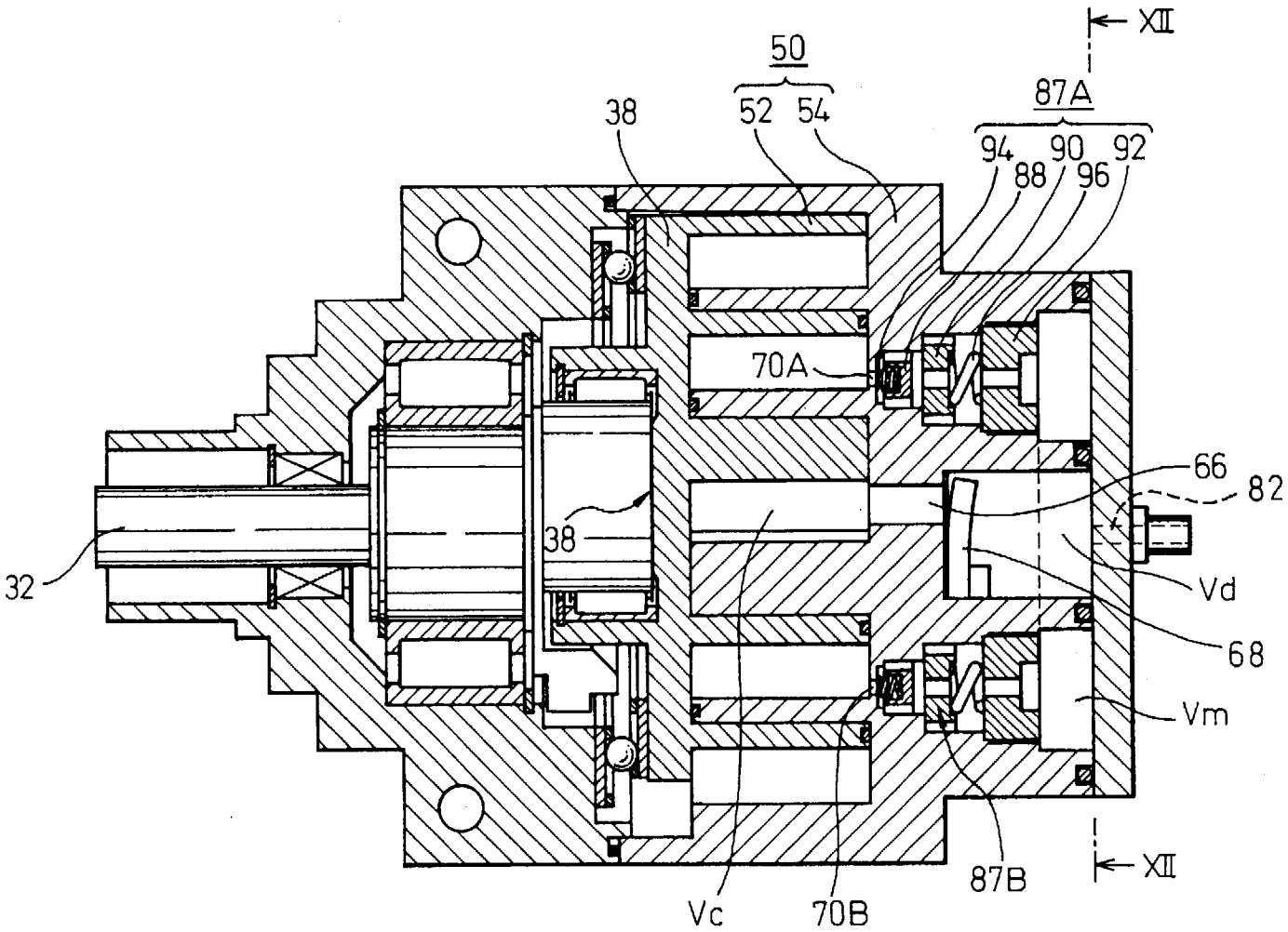
FIG. 21 is a longitudinal cross sectional view of the scroll compressor in FIG. 20.
Figure 22:
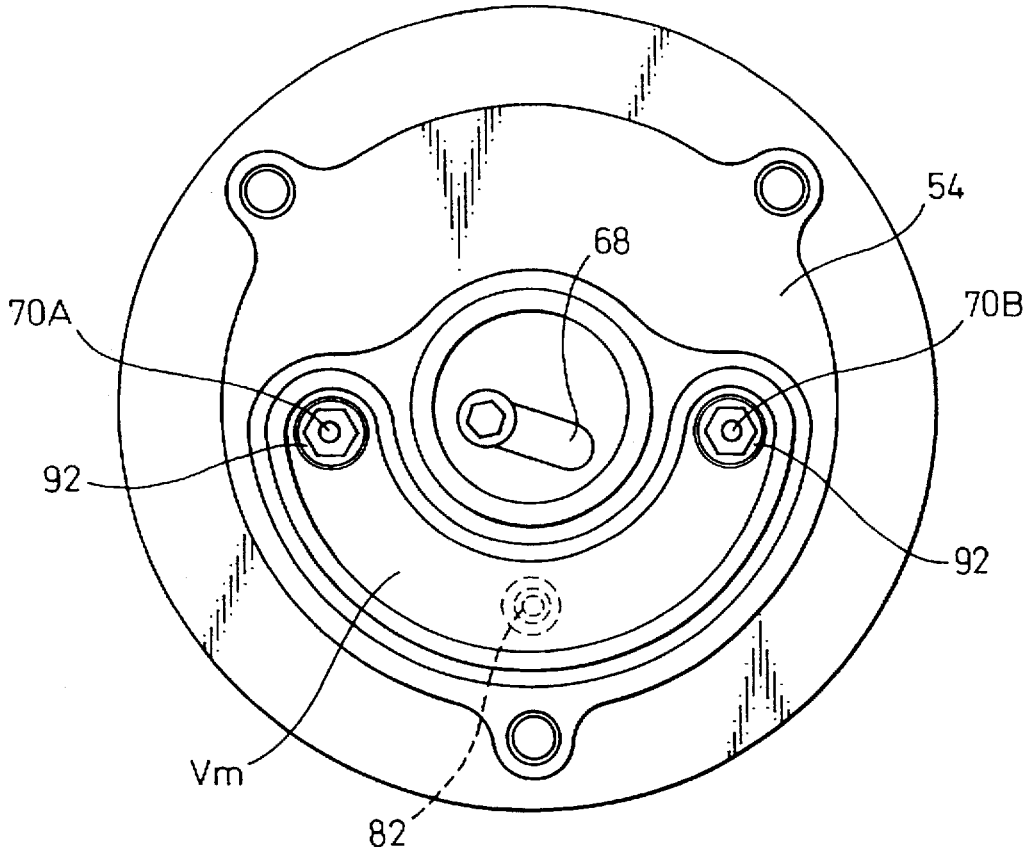
FIG. 22 is a view taken along a line XII—XII in FIG. 21.
Figure 23:
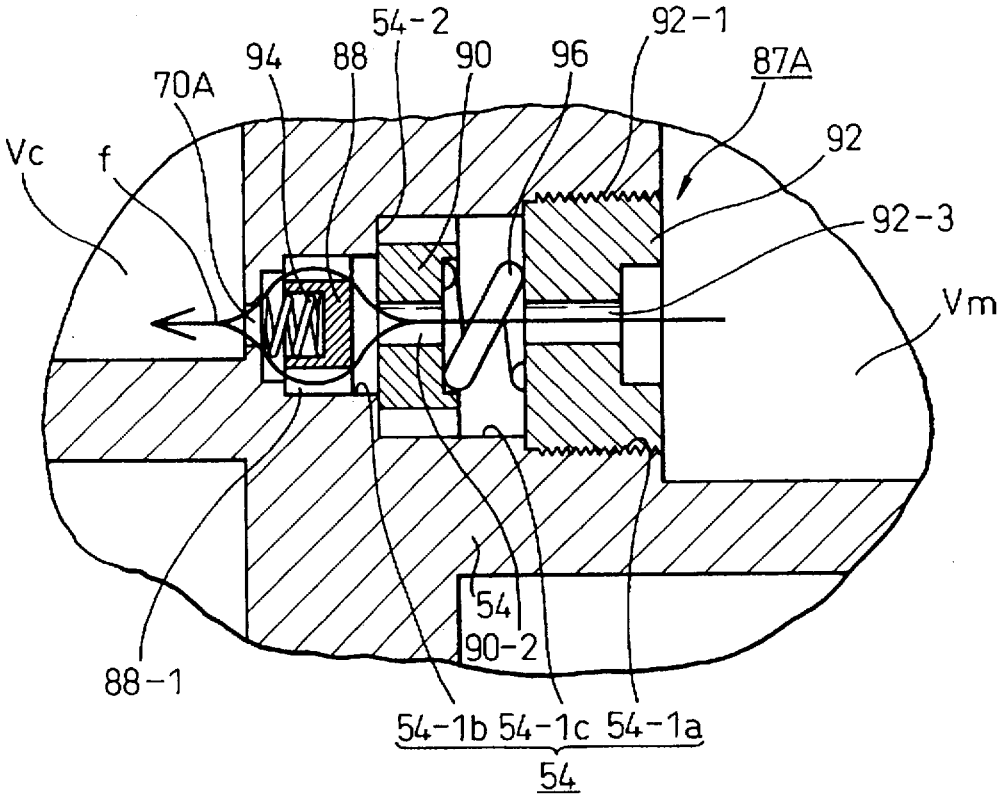
FIG. 23 is a partial enlarged view of FIG. 21 illustrating an opened position of a check valve.

FIG. 20 shows a second embodiment of the present invention, which is directed to provision of relief valves for preventing the pressure inside the operating chambers from being excessively increased. Namely, in FIG. 20, relief valves 86A and 86B are provided at locations downstream from the check valves 72A and 72B, respectively. As shown in FIG. 21, units for constructing these check valves and the relief valves are designated by reference numerals 87A and 87B and are located in the end plate of 54 of the movable scroll member 50. In FIG. 23, the end plate 54 is formed with a bore 54-1, which is constructed by a large diameter portion 54-1*a* directly opened to the intermediate pressure chamber Vm, a small diameter portion 54-1*b* opened to an operating chamber via the injection port 70A and a medium diameter portion 54-1*c* located between the large diameter portion 54-1*a* and the small diameter portion 54-1*b*.

The construction of the unit 87A constructing the check valve 72A and the relief valve 86A as shown in FIG. 20 will now be explained. The construction of the unit 87B is the same as that of the unit 87A, and thus a detailed explanation of unit 87B will be omitted. Namely, a first spool valve 88 formed as a tubular body made of a resin such as polytetrafluorethylene or a metal material is arranged in the small diameter portion 54-1*b*. A second spool valve 90 also formed as a tubular body made of a resin such as polytetrafluorethylene or a metal material is arranged in the medium diameter portion 54-1*c*. Furthermore, a stopper member 92 of a sleeve shape is, at its outer screw thread 92-1, screwed to the large diameter portion 54-1*a* for preventing the spool valves 88 and 90 from being separated from the end plate 54. The stopper 92 is formed with a central opening 92-3 for passage of the gaseous refrigerant. A first coil spring 94 is arranged for urging the first spool valve 88 away from the injection port 70A, i.e., toward the second spool valve 90. A second coil spring 96 is arranged so that the first spool member 88 is moved toward a shoulder 54-2 formed between the small diameter portion 54-1*b* and the medium diameter portion 54-*c*. The shoulder portion 54-2 functions as a valve seat for the second spool member 90.

Figure 24:
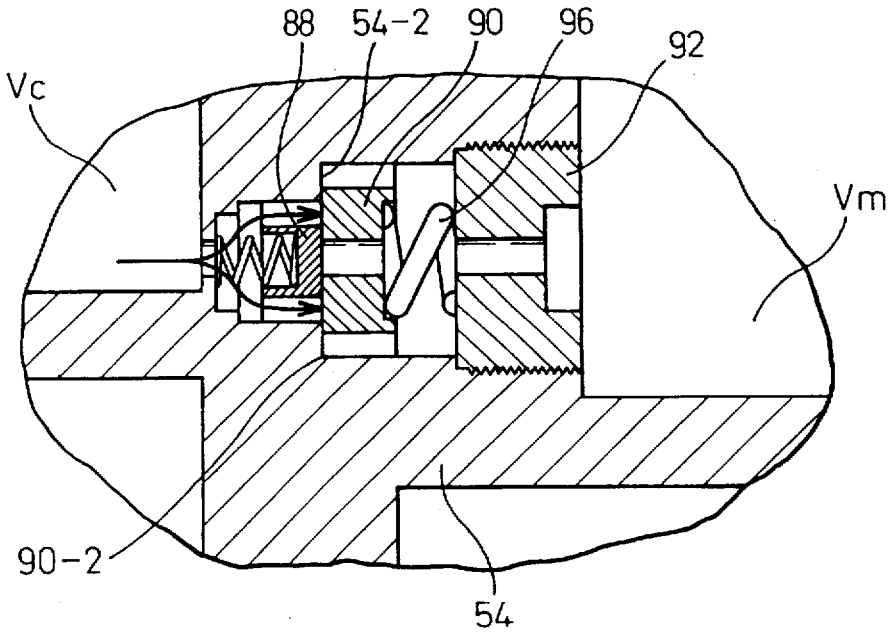
FIG. 24 is a partial enlarged view of FIG. 21 illustrating a closed position of a check valve.
Figure 26:
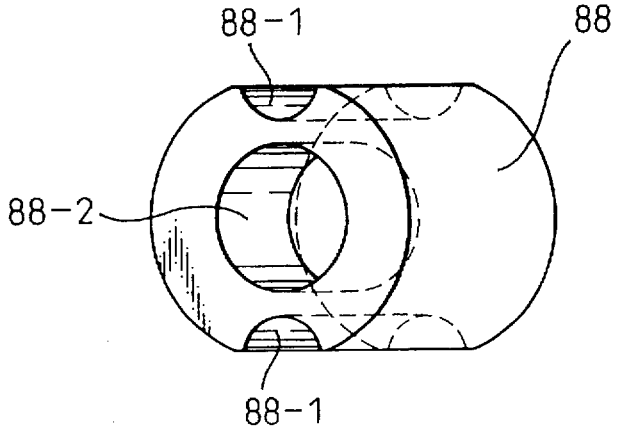
FIG. 26 is a perspective view of a first spool in FIGS. 23 to 25.

As shown in FIG. 26, the first spool valve 88 is formed with, at its outer cylindrical wall, a pair of diametrically axially extending grooves 88-1, which function as a passageway for a gaseous refrigerant directed to the injection port 70A or 70B for gas injection, and with, at its axial end adjacent to the injection port, a recess 88-2, to which the first coil spring 94, as shown in FIG. 24, is inserted.

Figure 27:
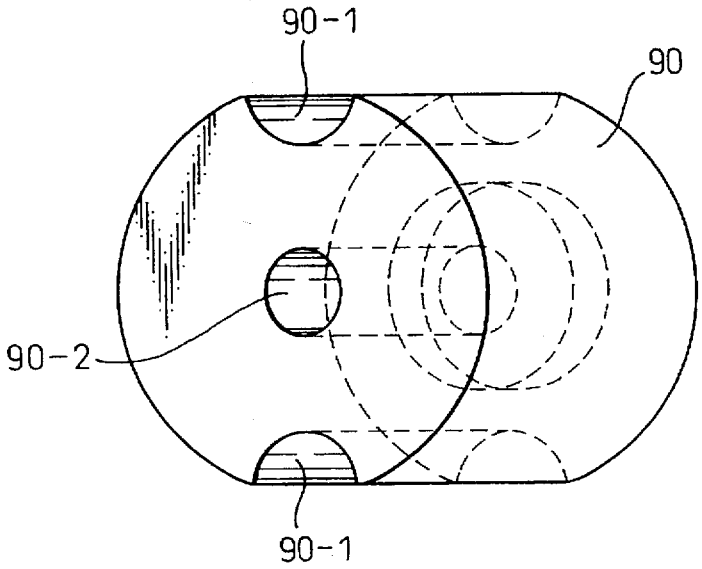
FIG. 27 is a perspective view of a second spool in FIGS. 23 to 25.

As shown in FIG. 27, the second spool member 90 is also formed with, at its outer cylindrical wall, a pair of diametrically opposite axially extending grooves 90-1, which also function as a passageway for a gaseous refrigerant from the intermediate pressure chamber Vm, and with a central passageway 90-2 for the passage of the gaseous refrigerant.

The operation of this embodiment is basically same as the operation of the first embodiment as explained with reference to FIGS. 1 and 6. Thus, the following explanation of the embodiment will focus on points which are different from the first embodiment to eliminate unnecessary repetition. Namely, a rotating movement of the shaft 38 causes the movable scroll member 32 to be rotated with reference to the stationary scroll member 50, which causes the operating chamber Vm between the scroll members 30 and 50 to be displaced radially inwardly, while the volume of the operating chambers Vc is reduced, as explained with reference to FIGS. 7 to 10 of the first embodiment. As a result, compression of the gaseous refrigerant from the evaporator 20 is done, so that the compressed gaseous refrigerant is discharged from the outlet port 66 to the outlet chamber Vd and is introduced to the condenser 12 for a repetition of the refrigerating cycle.

During the compression operation, the radial positions of paired compression chambers are varied as illustrated with reference to FIGS. 11 to 14 for the first embodiment. Namely, until the paired chambers are moved to the radial position as shown in FIG. 11, the pair of operating chambers are disconnected from the injection ports 70A and 70B. Then, the paired operating chambers are brought into a condition where they are in communication with the injection ports 70A and 70B, as shown by FIGS. 12 to 14. When the operating chambers in communication with the injection ports 70A and 70B are moved radially outwardly as shown in FIG. 12, the pressure at the operating chambers Vc is lower than the pressure at the intermediate pressure chamber Vm (pressure at the gas-liquid separator 16). As a result, in FIG. 23, the pressure at the intermediate pressure chamber Vm urges the second spool valve 90 to move toward the operating chamber Vc, until the second spool member 90 is, at its end surface, contacted with the shoulder 54-2, while the first spool 88 is detached from the second spool against the force of the first spring 94. As a result, a flow of a gaseous refrigerant as shown by an arrow f in FIG. 23 is obtained via the opening 92-3 in the stopper 92, the opening 90-2 of the second spool 90 and the grooves 88-1 of the first spool 88, so that the gaseous refrigerant at the intermediate pressure chamber Vm is injected into the operating chambers Vc as shown by the arrow f in FIG. 23. In this case, the pulsations in the pressure of the fluid injected into the operating chambers Vc are reduced at the intermediate chamber Vm.

When the pressure at the operating chamber Vm exceeds the pressure at the gas-liquid separator 16, the first spool member 88 is moved toward the second spool valve 90, so that the valve member 88 is in face-to-face contact with the valve member 90 as shown by FIG. 24, which causes the central bore 90-2 to be blocked, while the valve member 90 is seated on the valve seat 54-2. As a result, the gas injection from the intermediate pressure chamber Vm to the operating chamber Vc is stopped. Namely, in this embodiment, a combination of the first and second spool members 88 and 90 functions as a check valve 72A or 72B in FIG. 20, which prevents the gaseous refrigerant in the operating chamber Vc at a higher pressure from passing to the intermediate chamber Vm at a lower pressure.

Figure 25:
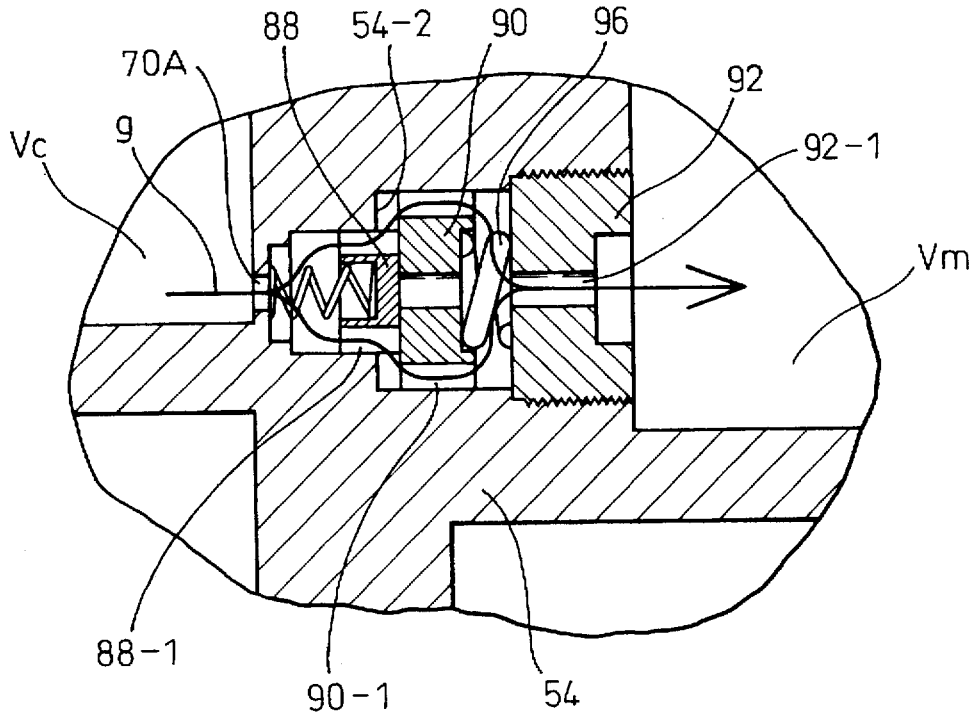
FIG. 25 is a partial enlarged view of FIG. 21 illustrating an open position of a relief valve.

When the compressor 10 is started in a cold condition, there may be a situation where a small amount of residual refrigerant in a liquid state exists in the operating chambers Vc. Such a liquid state refrigerant causes the pressure at the operating chamber Vc to increase rapidly. In such a situation, the increased pressure at the operating chamber Vc causes the first spool valve 88 to be moved toward the second spool valve 92 against the force of the spring 96, so that the spool valve 90 is detached from the valve seat 54-2, as shown in FIG. 25. As a result, a flow of the refrigerant from the operating chamber Vc to the intermediate pressure chamber Vm as shown by an arrow g is obtained via the injection port 70A, the grooves 88-1 in the spool valve 88, the grooves 90-1 in the spool valve 90 and the central bore 92-1 of the stopper 92. As a result, a rapid increase in the pressure at the operating chambers Vc is prevented, which may otherwise occur when residual liquid-state refrigerant exists in the operating chambers Vc during a cold start condition.

In this second embodiment, the first and second spool valves 88 and 90 cooperate to function as check valve 70A or 70B in FIG. 20 during a normal compression operation of the compressor 10, so that a gas injection is obtained during a period of reduced pressure of the operating chambers during an operating cycle, as shown in FIG. 23, while preventing the compressed gaseous refrigerant from leaking during a period of an increased pressure of the operating chamber during the operating cycle, as shown in FIG. 24.

Furthermore, the first and second spool valves 88 and 90 cooperate to function as relief valve 86A or 86B in FIG. 20 when a rapid increase in the pressure is generated in the operating chambers Vc due to residual liquid state refrigerant during a cold state of the compressor 10, so that the increased pressure at the operating chambers Vc is released to the intermediate pressure chamber Vm, thereby preventing the pressure in the operating chambers from being highly increased. In other words, the relief valves function merely to re-circulate the refrigerant from the operating chambers to the intermediate chamber (gas-liquid separator 16), thereby keeping a fixed value of the refrigerant in the refrigerating system. As a result, even in a situation where, after the operation of the relief valves 86A and 86B, the compressor re-enters into an operation, a desired amount of the refrigerant in the injection system is maintained, thereby preventing any shortage of the refrigerant, which may cause an insufficient injection operation as well as a insufficient lubrication of the compressor, which may occur in a prior art system where the pressure is released to the outside of the injection system.

The embodiment with the check valves as well as the relief valves can also applied to the system as reference by FIG. 18 in the first embodiment, where pairs of injection ports are provided.

Figure 28:
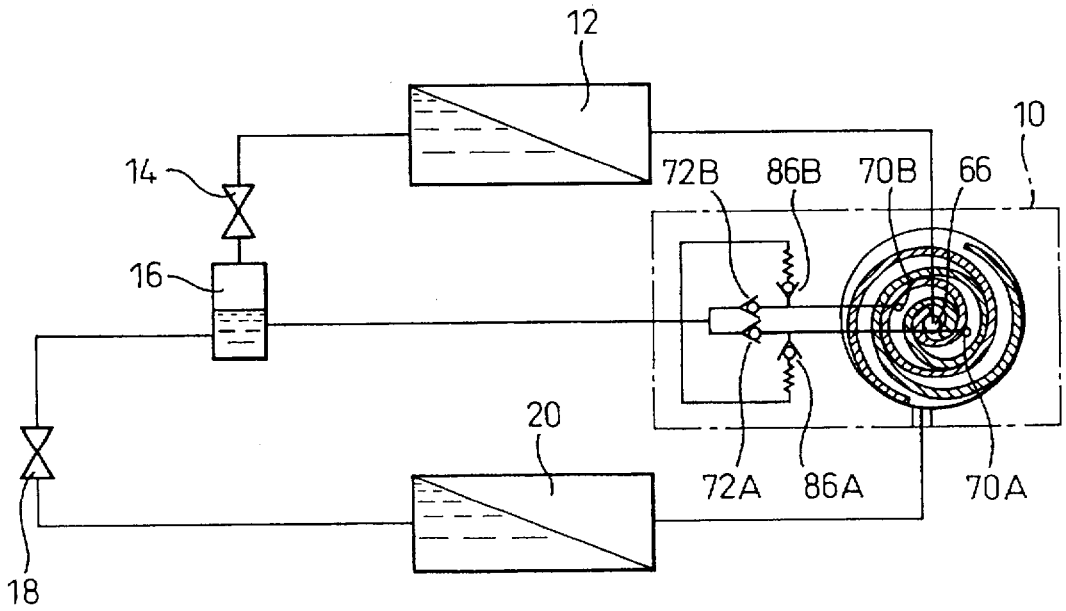
FIG. 28 illustrates a modified arrangement which is practiced in a liquid injection system.

FIG. 28 is an illustration of a modification of the second embodiment with a pressure relief system, which is applied to a liquid injection system explained with reference to FIG. 20 for the first embodiment.

We claim:

1. A scroll compressor comprising:

a casing;

a rotating shaft having a crank portion having an axis which is eccentric with respect to the rotating shaft;

a bearing for supporting the rotating shaft rotatably with respect to the casing;

a movable scroll member having an end plate and a scroll wall axially extending from the end plate;

a bearing rotatably supporting the movable scroll member on said crank portion so that the movable scroll member effects an orbital movement about the axis of the rotating shaft;

the movable scroll member and the stationary scroll member cooperating with each other so as to form operating chambers, which move radially inwardly, while the volume of the operating chambers is reduced, during the orbital movement of the movable scroll member;

an inlet port opened to the operating chambers when they are located radially outwardly, so that the fluid is introduced into the operating chambers;

an outlet port opened to the operating chambers when they are located radially inwardly, so that the fluid as compressed is discharged;

an injection port formed in the end plate of the stationary scroll member, the injection port being opened to the operating chamber for injecting, into the latter, the fluid which is at a pressure intermediate between the pressure of the refrigerant sucked via the inlet port and the pressure of the refrigerant injected from the outlet port, and;

an intermediate pressure chamber which is in communication with the injection port and which is for eliminating pressure pulsations in the fluid injected to the operating chamber from the injection port, wherein the intermediate pressure chamber is formed by the end plate of the stationary scroll member and the casing, and wherein the casing is formed with an intermediate pressure port which is for introducing the fluid at the intermediate pressure into the intermediate pressure chamber.

2. A scroll compressor according to claim 1, wherein a plurality of operating chambers and a plurality of injection ports are provided, and wherein said plurality of injection ports are provided to be opened to the respective operating chambers, so that the flow resistance from the intermediate pressure port to the injection ports via the intermediate chamber is balanced.

3. A scroll compressor comprising:

a casing;

a rotating shaft having a crank portion having an axis which is eccentric with respect to the rotating shaft;

a bearing for supporting the rotating shaft rotatably with respect to the casing;

a movable scroll member having an end plate and a scroll wall axially extending from the end plate;

a bearing rotatably supporting the movable scroll member on said crank portion so that the movable scroll member effects an orbital movement about the axis of the rotating shaft;

the movable scroll member and the stationary scroll member cooperating with each other so as to form operating chambers, which move radially inwardly, while the volume of the operating chambers is reduced, during the orbital movement of the movable scroll member;

an inlet port opened to the operating chambers when they are located radially outwardly, so that the fluid is introduced into the operating chambers;

an outlet port opened to the operating chambers when they are located radially inwardly, so that the fluid as compressed is discharged;

an injection port formed in the end plate of the stationary scroll member, the injection port being opened to the operating chamber for injecting, into the latter, the fluid which is at a pressure intermediate between the pressure of the refrigerant sucked via the inlet port and the pressure of the refrigerant injected from the outlet port;

an intermediate pressure chamber which is in communication with the injection port and which is for eliminating pressure pulsations in the fluid injected to the operating chamber from the injection port;

a check valve at the end plate of the stationary scroll member for blocking a reverse flow of the refrigerant from the operating chambers via the injection port; and a relief valve which is arranged to cancel the effect of the check valve when the pressure of the refrigerant in the operating chambers is higher than a predetermined value, which allows the pressure at the operating chamber to be outwardly released.

4. A scroll compressor according to claim 3, wherein it further comprises a passageway by-passing the check valve, on which passageway said relief valve is located, thereby allowing the released refrigerant to be returned to the intermediate pressure chamber.

5. A scroll compressor comprising:

a casing;

a rotating shaft having a crank portion having an axis which is eccentric with respect to the rotating shaft;

a bearing for supporting the rotating shaft rotatably with respect to the casing;

a movable scroll member having an end plate and a scroll wall axially extending from the end plate;

a bearing rotatably supporting the movable scroll member on said crank portion so that the movable scroll member effects an orbital movement about the axis of the rotating shaft;

the movable scroll member and the stationary scroll member cooperating with each other so as to form operating chambers, which move radially inwardly, while the volume of the operating chambers is reduced, during the orbital movement of the movable scroll member;

an inlet port opened to the operating chambers when they are located radially outwardly, so that the fluid is introduced into the operating chambers;

an outlet port opened to the operating chambers when they are located radially inwardly, so that the fluid as compressed is discharged;

an injection port formed in the end plate of the stationary scroll member, the injection port being opened to the operating chamber for injecting, into the latter, the fluid which is at a pressure intermediate between the pressure of the refrigerant sucked via the inlet port and the pressure of the refrigerant injected from the outlet port, and;

an intermediate pressure chamber which is in communication with the injection port and which is for eliminating pressure pulsations in the fluid injected to the operating chamber from the injection port, wherein the intermediate pressure chamber is formed by the end plate of the stationary scroll member and the casing, and wherein the casing is formed with an intermediate pressure port which is for introducing the fluid at the intermediate pressure into the intermediate pressure chamber.

* * * * *